US011910976B2

(12) United States Patent
Lin

(10) Patent No.: US 11,910,976 B2
(45) Date of Patent: Feb. 27, 2024

(54) MULTIFUNCTIONAL CLEANING MACHINE

(71) Applicant: PANIOR INC, Denver, CO (US)

(72) Inventor: Ligen Lin, Shenzhen (CN)

(73) Assignee: PANIOR INC, Denver, CO (US)

( * ) Notice: Subject to any disclaimer, the term of this patent is extended or adjusted under 35 U.S.C. 154(b) by 0 days.

(21) Appl. No.: 18/336,077

(22) Filed: Jun. 16, 2023

(65) Prior Publication Data

US 2023/0329511 A1 Oct. 19, 2023

(30) Foreign Application Priority Data

Jun. 1, 2023 (CN) ..... 202321385355.8

(51) Int. Cl.
*A47L 11/40* (2006.01)

(52) U.S. Cl.
CPC ..... *A47L 11/4072* (2013.01); *A47L 11/4077* (2013.01); *A47L 11/4088* (2013.01)

(58) Field of Classification Search
CPC ..... A47L 11/4072; A47L 11/4077; A47L 11/4078
USPC ..... 134/184
See application file for complete search history.

(56) References Cited

U.S. PATENT DOCUMENTS

2006/0037635 A1 2/2006 Rhodes
2007/0016328 A1* 1/2007 Ziegler ..... A47L 9/009 701/23
2007/0277562 A1 12/2007 Uhlin
2011/0036380 A1 2/2011 Joost et al.
2018/0368644 A1* 12/2018 Chavana, Jr. ..... A47L 11/34

* cited by examiner

*Primary Examiner* — Tinsae B Ayalew
(74) *Attorney, Agent, or Firm* — Zhigang Ma

(57) ABSTRACT

The present disclosure discloses a multifunctional cleaning machine. The multifunctional cleaning machine includes a housing, a pipe, a nozzle, a plurality of wheel assemblies and a locking means. The pipe connected to the housing, the pipe including a water inlet and a water outlet, the water inlet being located on an upper side of the housing, the water outlet being located on a lower side of the housing, and the water inlet being configured for connecting to a high pressure water source. The nozzle connected to the water outlet. The wheel assemblies rotatably connected to the housing by the connecting assembly. The locking means connected to the housing and configured for locking the wheel assembly.

9 Claims, 8 Drawing Sheets

MULTIFUNCTIONAL CLEANING MACHINE

CROSS-REFERENCE TO RELATED APPLICATIONS

The application claims priority of Chinese patent application CN2023213853558, filed on Jun. 1, 2023, which is incorporated herein by reference in its entireties.

TECHNICAL FIELD

The present disclosure relates to the technical field of cleaning machines, in particular to a multifunctional cleaning machine.

BACKFLOOR

Cleaning machine is mostly used for floor cleaning of hotels, parks and squares, factory workshops and other places, suitable for dirt cleaning such as surface oil for tile floor, stone floor, epoxy floor, emery floor, terrazzo floor, plastic floor, vitrified bricks, PVC floor and other hard floor, and more time-saving, energy-saving, money-saving, efficient, better in cleaning effect in comparison with to manual cleaning. However, the existing cleaning machine on the market is single in function and can only clean floor, so the usage scenario is single. As a result, the users' requirements in more scenarios cannot be meet. Therefore, there is an urgent need to provide a multifunctional cleaning machine in markets to meet the users' requirements in more scenarios.

SUMMARY

In order to overcome the defects of the prior art, the present disclosure provides a multi functional cleaning machine, which can used for cleaning both floor and vehicle bottoms to meet the users' requirements in more scenarios.

The technical solution adopted by the present disclosure to solve the technical problem is as follows: a multifunctional cleaning machine, including: a housing; a pipe, connected to the housing, the pipe including a water inlet and a water outlet, the water inlet being located on an upper side of the housing, the water outlet being located on a lower side of the housing, and the water inlet being configured for connecting to a high pressure water source; a nozzle, connected to the water outlet; a connecting assembly; a plurality of wheel assemblies, rotatably connected to the housing by the connecting assembly; a locking means, connected to the housing and configured for locking the wheel assembly; when the locking means is released from locking the wheel assembly, the wheel assembly being flippable from the lower side of the housing to the upper side of the housing, or the wheel assembly being flippable from the upper side of the housing to the lower side of the housing; and when the locking means locks the wheel assembly, the locking means locking and fixing the wheel assembly to the lower side of the housing or the upper side of the housing.

As the improvement of the present disclosure, the connecting assembly includes a connecting shaft, a connecting bracket, and a locking bracket, the locking bracket being connected to the housing; the locking bracket is provided with a first connecting port, the connecting shaft is connected to a third connecting port, and the connecting shaft is rotatable within the third connecting port; the wheel assembly is connected to the connecting bracket, such that the wheel assembly and the connecting bracket are integrated into a whole; and the connecting bracket is provided with a second connecting port, and the connecting bracket sleeves the connecting shaft through the second connecting port, such that the connecting bracket and the wheel assembly are rotatable with the connecting shaft.

As the improvement of the present disclosure, the locking means is a locking rod, the locking rod being configured for locking the connecting shaft; when the locking rod is released from locking the connecting shaft, the connecting shaft is rotatable within the first connecting port, and the connecting bracket and the wheel assembly are rotatable with the connecting shaft, such that the wheel assembly is flippable from the lower side of the housing to the upper side of the housing, or the wheel assembly is flippable from the upper side of the housing to the lower side of the housing; and when the locking rod locks the connecting shaft, the connecting shaft is not rotatable within the first connecting port, the connecting bracket and the wheel assembly are not rotatable with the connecting shaft, such that the wheel assembly is locked and fixed to the lower side of the housing or the upper side of the housing.

As the improvement of the present disclosure, the locking bracket is further provided with a locking channel, the locking channel passes through an outer side of the locking bracket to the second connecting port, and the locking rod is slidable within the locking channel; the connecting shaft is provided with a first locking hole and a second locking hole, when the locking rod slides within the locking channel into the first locking hole, the locking rod locks the connecting shaft, and the connecting shaft is not rotatable within the first connecting port, such that the locking rod locks and fixes the wheel assembly to the lower side of the housing; when the locking rod slides within the locking channel into the second locking hole, the locking rod locks the connecting shaft, and the connecting shaft is not rotatable within the first connecting port, such that the locking rod locks and fixes the wheel assembly to the upper side of the housing; and when the locking rod slides out of the locking channel to disengage from the first locking hole or the second locking hole, the connecting shaft is rotatable within the first connecting port, and the connecting bracket and the wheel assembly are rotatable with the connecting shaft, such that the wheel assembly is flippable from the lower side of the housing to the upper side of the housing, or the wheel assembly is flippable from the upper side of the housing to the lower side of the housing.

As the improvement of the present disclosure, the locking rod is sleeved with a resilient reset means, when the locking rod slides out of the locking channel to disengage from the first locking hole or the second locking hole, the resilient reset means is compressed; and when the locking rod slides within the locking channel into the first locking hole or the second locking hole, a resilient reset force provided by the resilient reset means when compressed can push the locking rod to be locked in the first locking hole or the second locking hole.

As the improvement of the present disclosure, the nozzle is T-shaped to form a connector at an upper side and a water spray rod at a lower side, one end of the connector is rotatably connected to the water outlet, and the other end of the connector is connected to the water spray rod; and a first water jet is provided on one side of the water spray rod, and a second water jet is provided on the other side of the water spray rod.

As the improvement of the present disclosure, a splash shield is provided on the lower side of the housing.

As the improvement of the present disclosure, the splash shield is formed by stacking a number of layers of screw rods.

As the improvement of the present disclosure, the wheel assembly includes a wheel and a wheel bracket, the wheel is connected to the wheel bracket, and the wheel bracket is rotatably connected to the connecting bracket through a rotating shaft.

As the improvement of the present disclosure, the connecting shaft is further provided with a locking thread, the multifunctional cleaner further includes a locking nut, and when the locking bracket and the connecting bracket sleeve the connecting shaft, the locking nut is connected to the locking thread to press and lock the locking bracket and the connecting bracket to the connecting shaft.

The beneficial effects of the present disclosure are as follows: the present disclosure provides a multifunctional cleaning machine, including a housing; a pipe, connected to the housing; the pipe having a water inlet and a water outlet, the water inlet being located on an upper side of the housing, the water outlet being located on a lower side of the housing, and the water inlet being configured for connecting to a high pressure water source; a nozzle, connected to the water outlet; a connecting assembly; a plurality of wheel assemblies, rotatably connected to the housing by the connecting assembly; a locking means, connected to the housing and configured for locking the wheel assembly; when the locking means is released from locking the wheel assembly, the wheel assembly is flippable from the lower side of the housing to the upper side of the housing, or the wheel assembly is flippable from the upper side of the housing to the lower side of the housing; when the locking means locks the wheel assembly, the locking means locks and fixes the wheel assembly to the lower side of the housing or the upper side of the housing; when a user needs to use the nozzle of the cleaning machine to spray wash the floor, the locking means can be released from locking the wheel assembly to flip the wheel assembly to the lower side of the housing, and then the wheel assembly is locked and fixed to the lower side of the housing by the locking means, such that when a wheel is turned on the floor, the lower side of the housing and the nozzle face the floor and thus the nozzle can spray wash the floor; when the user needs to use the nozzle of the cleaning machine to spray wash the vehicle bottom, the locking means can be released from locking the wheel assembly to flip the wheel assembly to the upper side of the housing, and then the wheel assembly is locked and fixed to the upper side of the housing by the locking means, such that when the wheel is turned on the floor, the lower side of the housing and the nozzle face the vehicle bottom, and thus the nozzle can spray wash the vehicle bottom.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
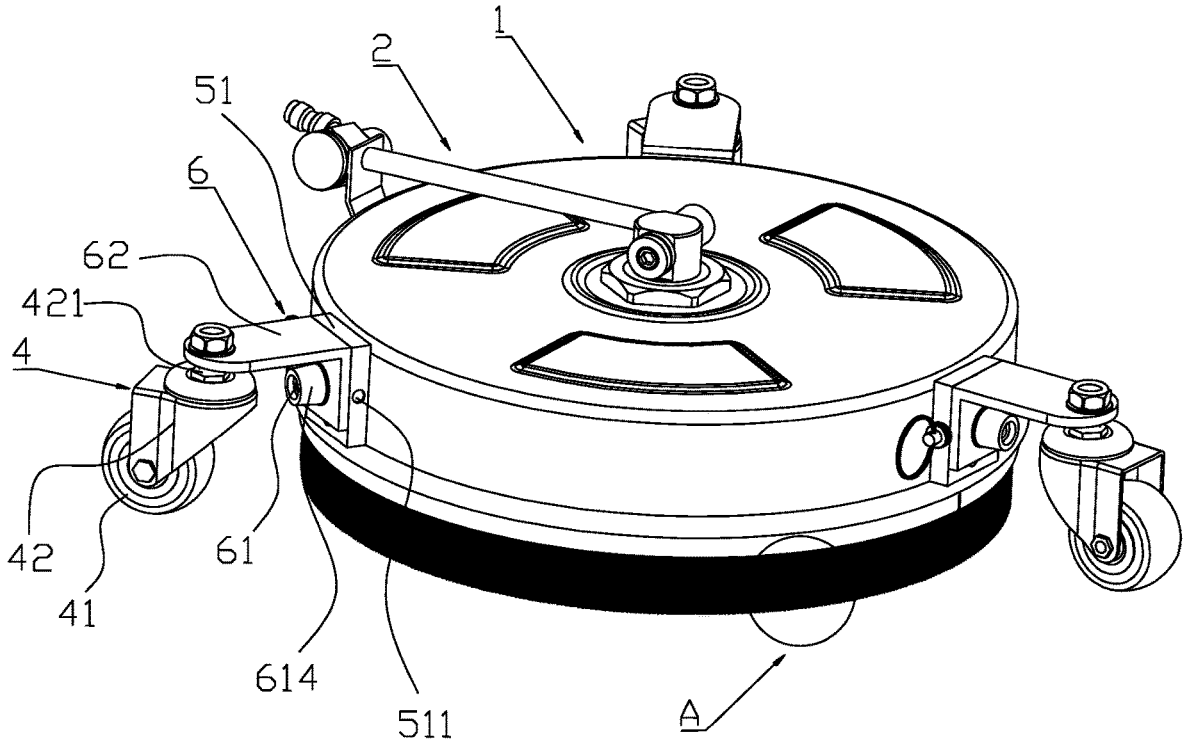
FIG. 1 is a schematic diagram of an overall structure of a wheel assembly flipped from an upper side of a housing to a lower side of the housing of the present disclosure.
Figure 2:
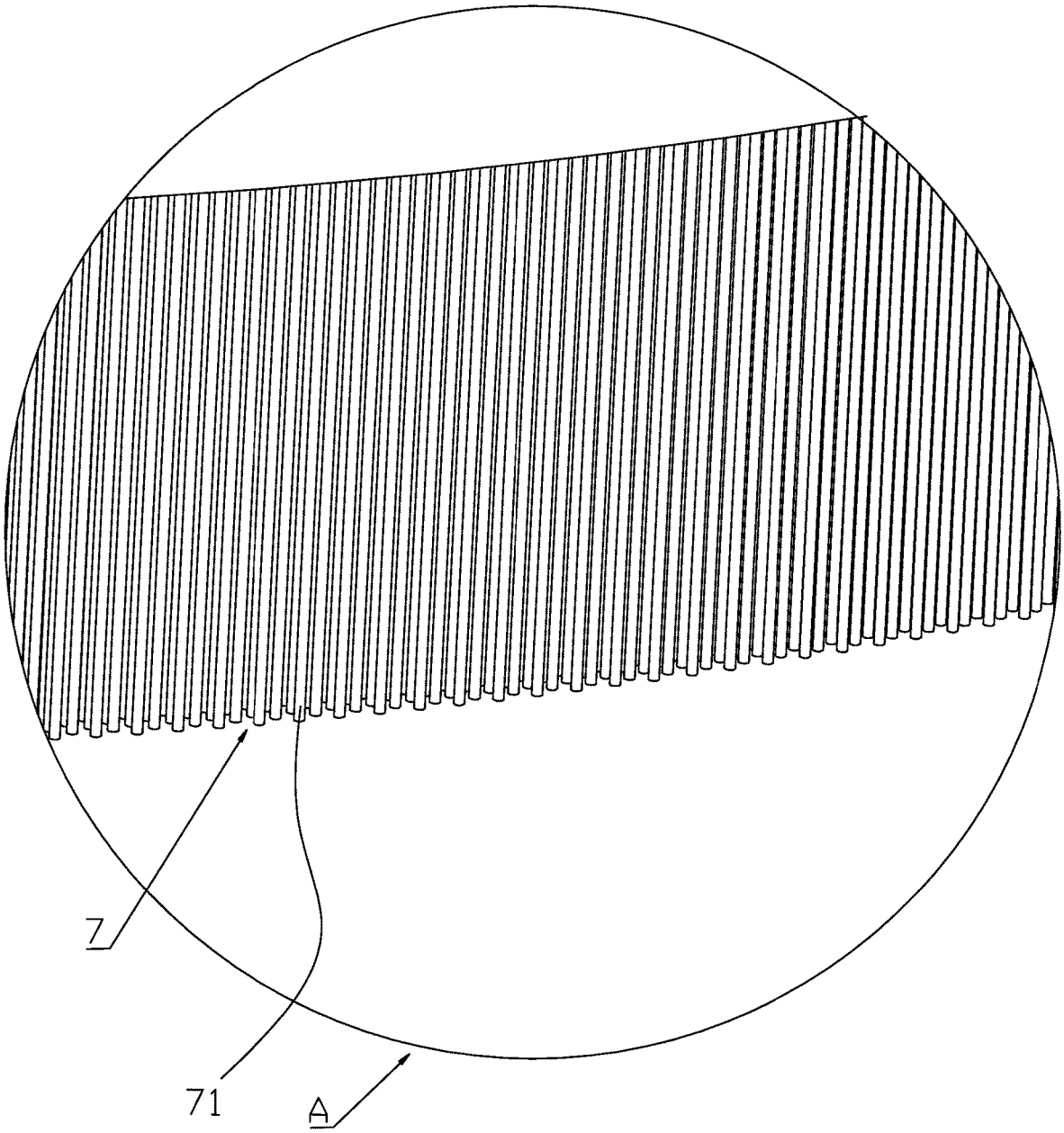
FIG. 2 is an enlarged view of part A in FIG. 1.
Figure 3:
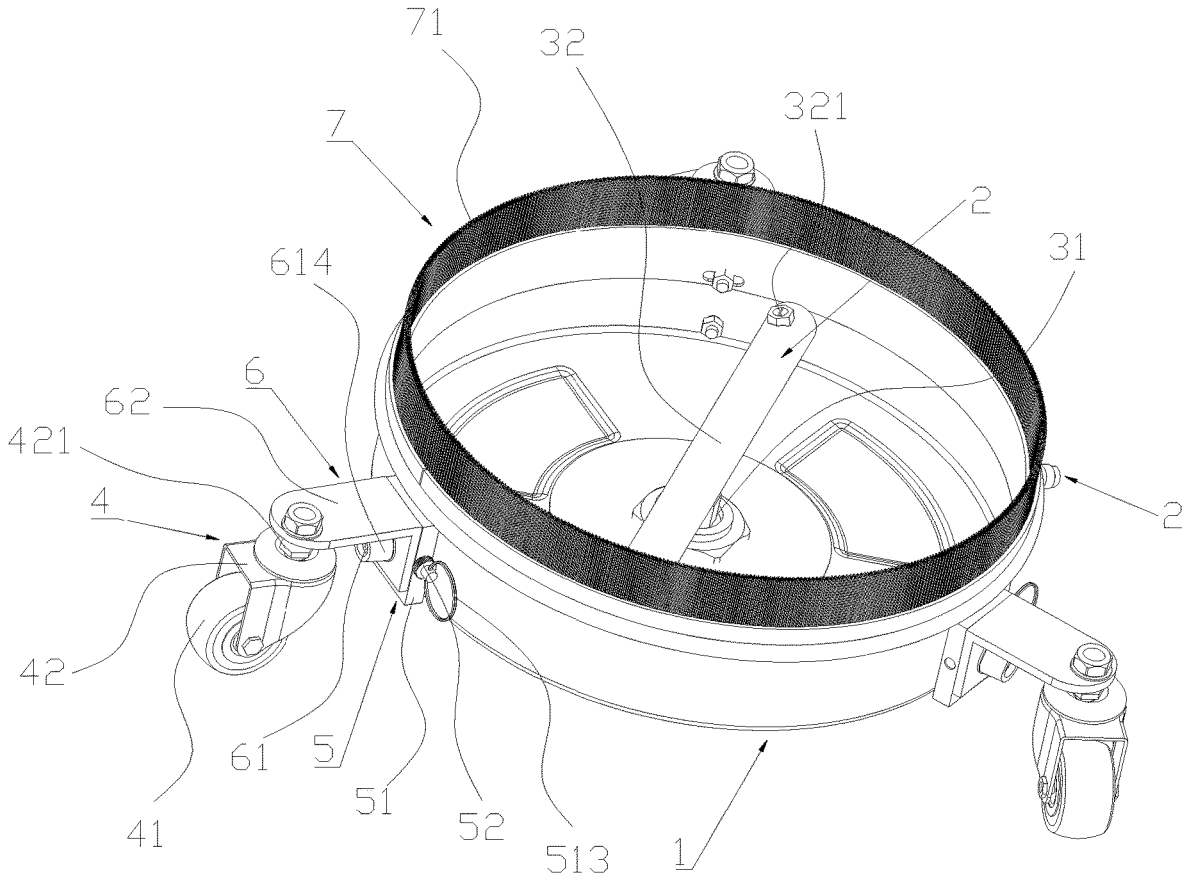
FIG. 3 is a schematic diagram of an overall structure of the wheel assembly flipped from the lower side of the housing to the upper side of the housing of the present disclosure.
Figure 4:
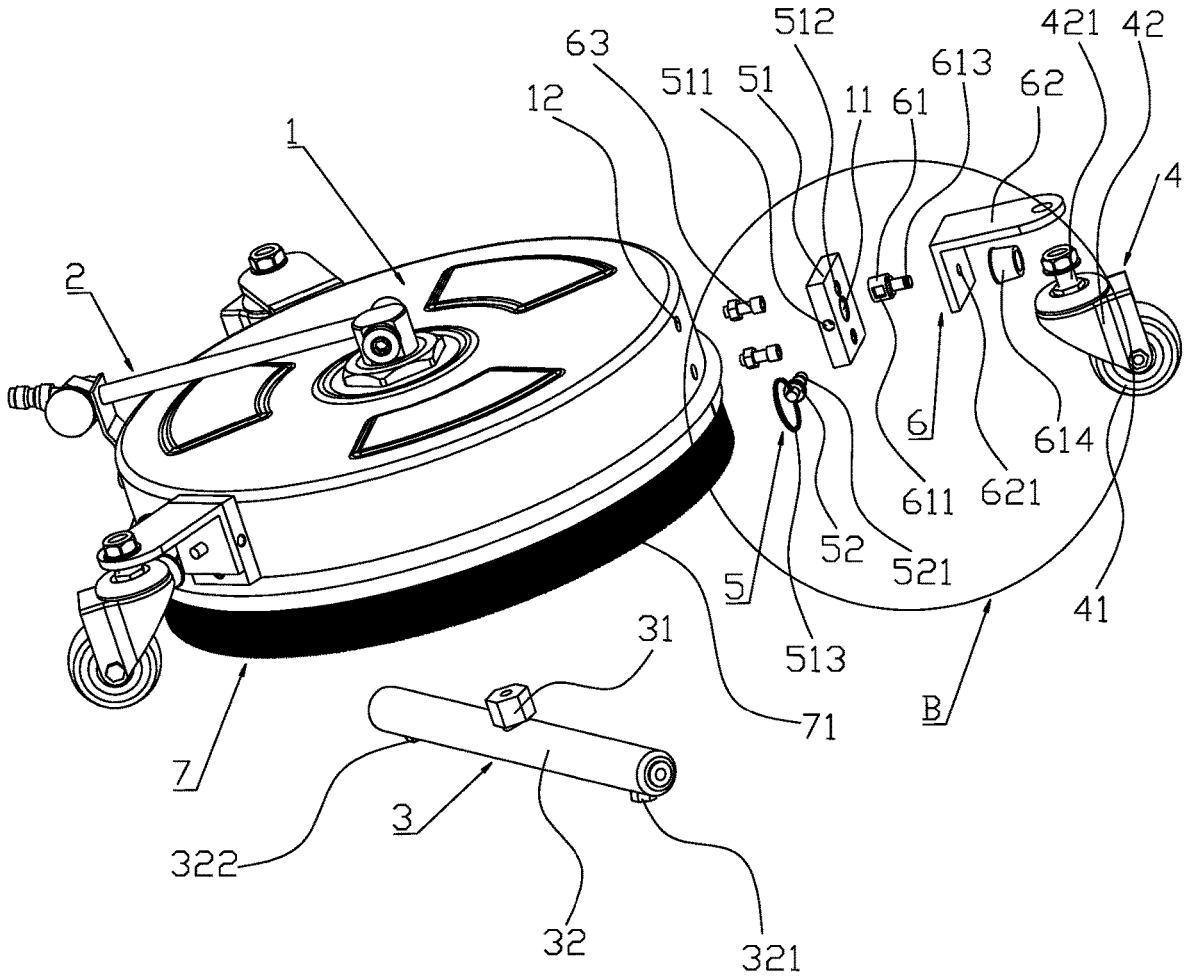
FIG. 4 is an exploded view of the present disclosure.
Figure 5:
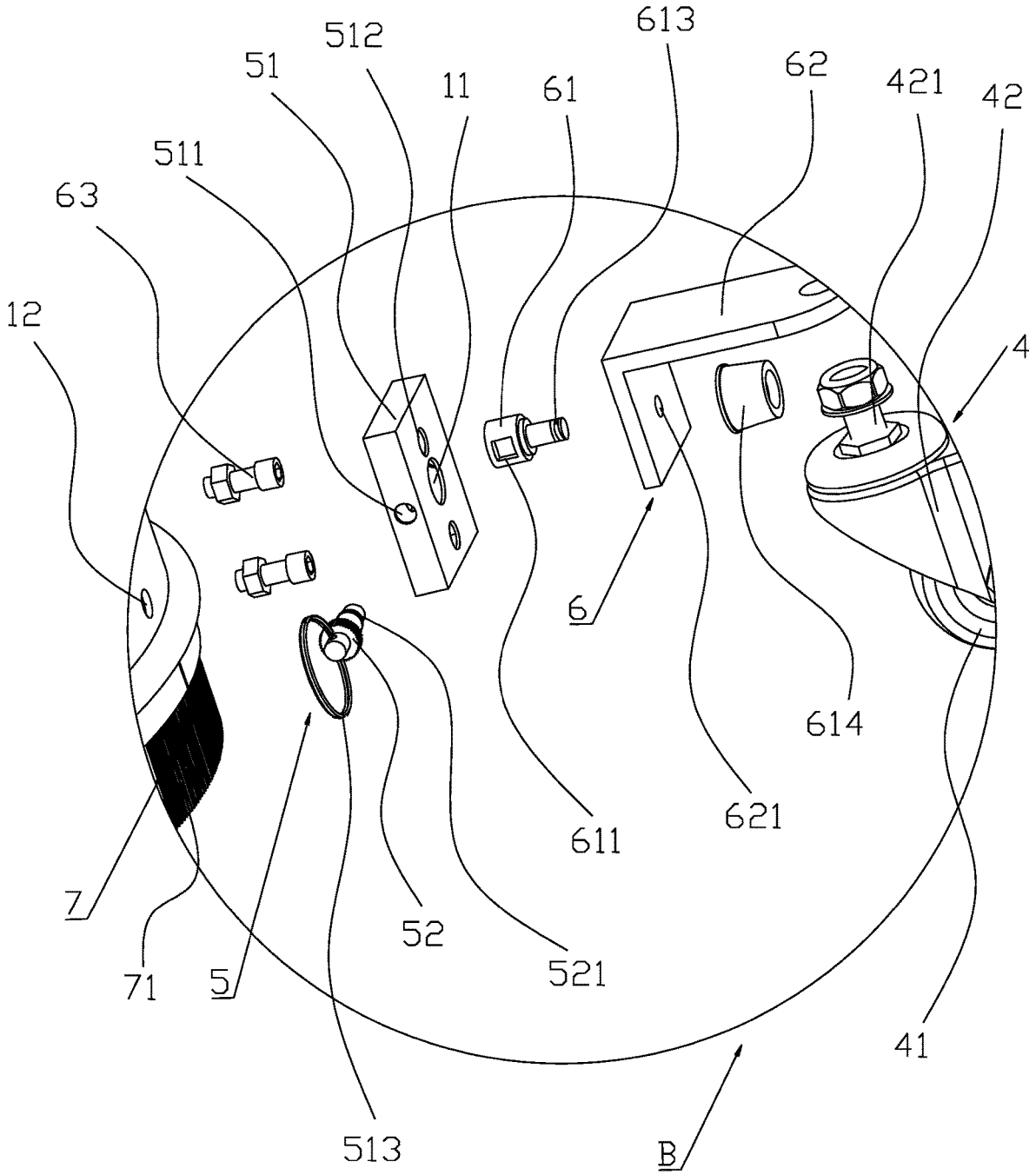
FIG. 5 is an enlarged view of part B in FIG. 4.
Figure 6:
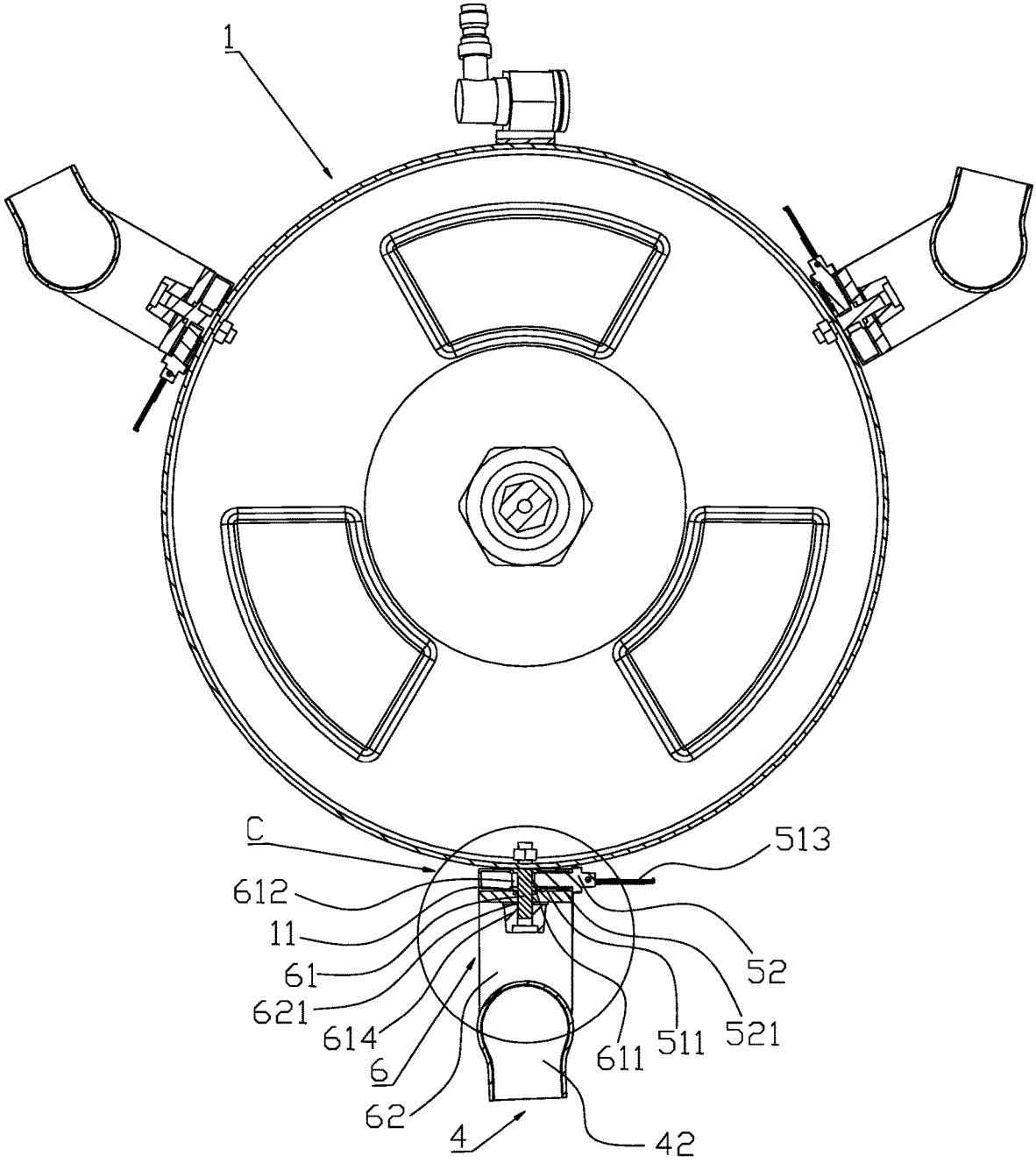
FIG. 6 is a cross-sectional view cut along a rotating shaft, a locking bracket, a connecting bracket, a wheel bracket, a locking rod, a first locking hole, a second locking hole, and a locking channel.
Figure 7:
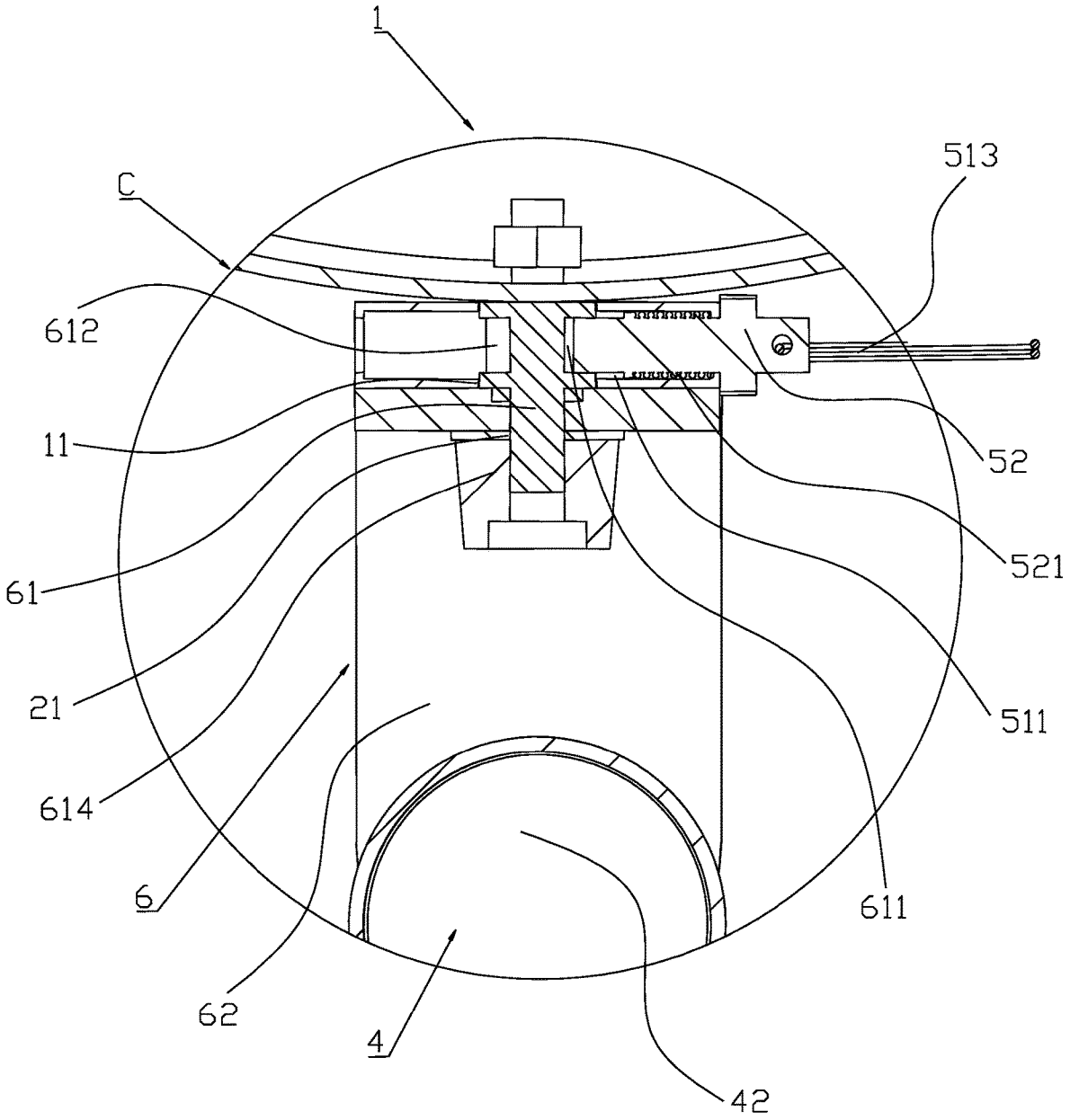
FIG. 7 is an enlarged view of part C in FIG. 6.
Figure 8:
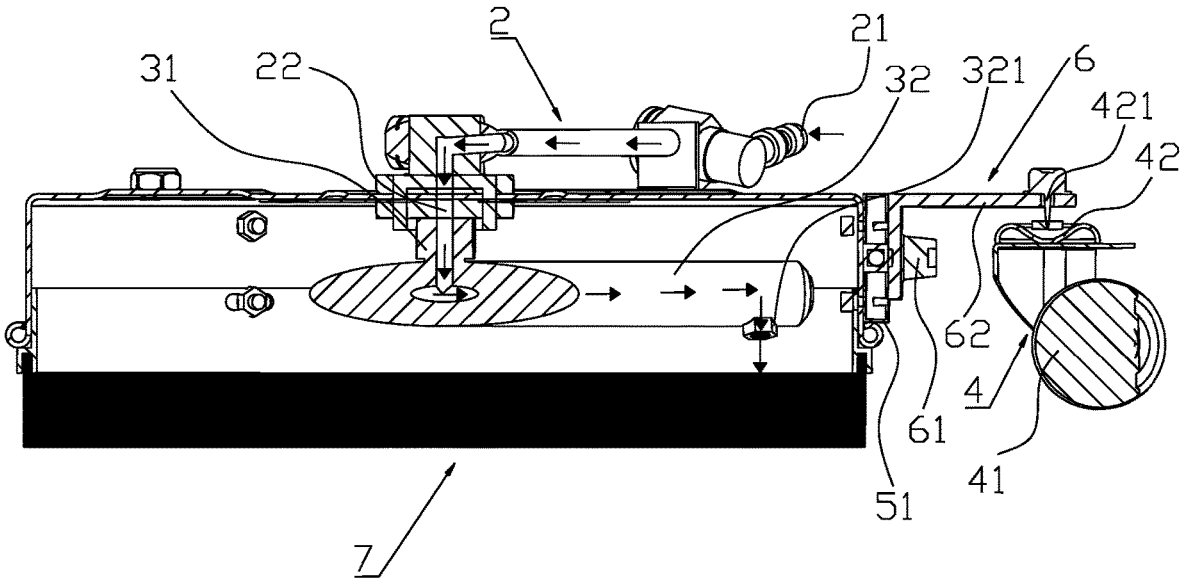
FIG. 8 shows a cross-sectional view cut along a nozzle and a water spray pipe, and a schematic diagram of a water flow direction.

Referring to FIGS. 1 to 8, provided is a multifunctional cleaning machine, including:

- a housing 1;
- a pipe 2, connected to the housing 1, the pipe 2 having a water inlet 21 and a water outlet 22, the water inlet being located on an upper side of the housing, the water outlet being located on a lower side of the housing, and the water inlet 21 being configured for connecting to a high pressure water source;
- a nozzle 3, connected to the water outlet 22;
- a connecting assembly 6;
- a plurality of wheel assemblies 4, rotatably connected to the housing 1 through the connecting assembly 6;
- a locking means 5, connected to the housing 1 and configured for locking the wheel assembly 4;
- when the locking means 5 is released from locking the wheel assembly 4, the wheel assembly 4 being flippable from the lower side of the housing 1 to the upper side of the housing 1, or the wheel assembly 4 being flippable from the upper side of the housing 1 to the lower side of the housing 1; and when the locking means 5 locks the wheel assembly 4, the locking means 5 locking and fixing the wheel assembly 4 to the lower side of the housing 1 or the upper side of the housing 1.

With the above structure, when a user needs to use the nozzle of the cleaning machine to spray wash floor, the locking means can be released from locking the wheel assembly to flip the wheel assembly to the lower side of the housing. Then the wheel assembly is locked and fixed to the lower side of the housing by the locking means. In this way, when a wheel is turned on the floor, the lower side of the housing and the nozzle face the floor and thus the nozzle can spray wash the floor. When the user needs to use the nozzle of the cleaning machine to spray wash a vehicle bottom, the locking means can be released from locking the wheel assembly to flip the wheel assembly to the upper side of the housing. Then the wheel assembly is locked and fixed to the upper side of the housing by the locking means. In this way, when the wheel is turned on the floor, the lower side of the housing and the nozzle face the vehicle bottom, and thus the nozzle can spray wash the vehicle bottom.

In this embodiment, the connecting assembly 6 includes a connecting shaft 61, a connecting bracket 62, and a locking bracket 51. The locking bracket is connected to the housing. The locking bracket 51 is provided with a first connecting port 11. The connecting shaft 61 is connected to a third connecting port 11, and the connecting shaft 61 is rotatable within the third connecting port 11. The wheel assembly 4 is connected to the connecting bracket 62, such that the wheel assembly 4 and the connecting bracket 62 are integrated into a whole. The connecting bracket 62 is provided with a second connecting port 621. The connecting bracket 62 sleeves the connecting shaft 61 through the second connecting port 621, such that the connecting bracket 62 and the wheel assembly 4 are rotatable with the connecting shaft 61. The locking means 5 is a locking rod 52. The locking rod 52 is configured for locking the connecting shaft 61. When the locking rod 52 is released from locking the connecting shaft 61, the connecting shaft 61 is rotatable within the first connecting port 11, and the connecting bracket 62 and the wheel assembly 4 are rotatable with the connecting shaft 61, such that the wheel assembly 4 is flippable from the lower side of the housing 1 to the upper side of the housing, or the wheel assembly 4 is flippable from the upper side of the housing 1 to the lower side of the housing. When the locking rod 52 locks the connecting shaft 61, the connecting shaft 61 is not rotatable within the first connecting port 11, and the connecting bracket 62 and the wheel assembly 4 are not rotatable with the connecting shaft 61, such that the wheel assembly 4 is locked and fixed to the lower side of the housing 1 or the upper side of the housing. Specifically, the locking bracket 51 is further provided with a locking channel 511. The locking channel 511 passes through an outer side of the locking bracket 51 to the second connecting port 621. The locking rod 52 is slidable within the locking channel 511. The connecting shaft 61 is provided with a first locking hole 611 and a second locking hole 612. When the locking rod 52 slides within the locking channel 511 into the first locking hole 611, the locking rod 52 locks the connecting shaft 61, and the connecting shaft 61 is not rotatable within the first connecting port 11, such that the locking rod 52 locks and fixes the wheel assembly 4 to the lower side of the housing 1. When the locking rod 52 slides within the locking channel 511 into the second locking hole 612, the locking rod 52 locks the connecting shaft 61, and the connecting shaft 61 is not rotatable within the first connecting port 11, such that the locking rod 52 locks and fixes the wheel assembly 4 to the upper side of the housing 1. When the locking rod 52 slides out of the locking channel 511 to disengage from the first locking hole 611 or the second locking hole 612, the connecting shaft 61 is rotatable within the first connecting port 11, and the connecting bracket 62 and the wheel assembly 4 are rotatable with the connecting shaft 61, such that the wheel assembly 4 is flippable from the lower side of the housing 1 to the upper side of the housing, or the wheel assembly 4 is flippable from the upper side of the housing 1 to the lower side of the housing. Further, the locking bracket 51 is connected to the housing 1 by a screw 9. With the above structure, when the user needs to use the nozzle of the cleaning machine to spray wash the floor, the locking rod can be slid out of the locking channel to disengage from the first locking hole or the second locking hole to release the locking rod from locking the connecting shaft, such that the connecting shaft is rotatable within the first connecting port, the connecting bracket and the wheel assembly are rotatable with the connecting shaft, and the wheel assembly is flipped to the lower side of the housing. Then the locking rod is slid within the locking channel into the first locking hole, the locking rod locks the connecting shaft, the connecting shaft is not rotatable within the first connecting hole, and the wheel assembly is locked and fixed to the lower side of the housing by the locking rod. In this way, when a wheel is turned on the floor, the lower side of the housing and the nozzle face the floor and the nozzle can spray wash the floor. When the user needs to use the nozzle of the cleaning machine to spray wash the vehicle bottom, the locking rod can be slid out of the locking channel to disengage from the first locking hole or the second locking hole to release the locking rod from locking the connecting shaft, such that the connecting shaft is rotatable within the first connecting port, the connecting bracket and the wheel assembly are rotatable with the connecting shaft, and the wheel assembly is flipped to the upper side of the housing. Then the locking rod is slid within the locking channel into the second locking hole, the locking rod locks the connecting shaft, the connecting shaft is not rotatable within the first connecting port, and the locking rod locks and fixes the wheel assembly to the upper side of the housing. In this way, when the wheel is turned on the floor, the lower side of the housing and the nozzle face the vehicle bottom and the nozzle can spray wash the vehicle bottom.

In this embodiment, the locking rod 52 is sleeved with a resilient reset means 521. When the locking rod 52 slides out of the locking channel 511 to disengage from the first locking hole 611 or the second locking hole 612, the resilient reset means 521 is compressed. When the locking rod 52 slides within the locking channel 511 into the first locking hole 611 or the second locking hole 612, a resilient reset force provided by the resilient reset means 521 when compressed can push the locking rod 52 to be locked in the first locking hole 611 or the second locking hole 612. The resilient reset means is a spring. It may also be a resilient pad, or the like. Specifically, the locking rod is provided with a pull ring 513. With the above structure, the spring is compressed when the pull ring is pulled and the locking rod slides out of the locking channel to disengage from the first locking hole or the second locking hole. When the pull ring is released, a resilient reset force generated by the spring when compressed can push the locking rod to be locked in the first locking hole or the second locking hole, such that the locking rod locks the connecting shaft, the connecting shaft is rotatable within the first connecting port, and thus the locking rod locks the wheel assembly to the lower side or the upper side of the housing.

In this embodiment, the nozzle 3 is T-shaped to form a connector 31 at an upper side and a water spray rod 32 at a lower side. One end of the connector 31 is rotatably connected to the water outlet 22. The other end of the connector 31 is connected to the water spray rod 32. A first water jet 321 is provided on one side of the water spray rod 32. A second water jet 322 is provided on the other side of the water spray rod 32. With the above structure, when the water inlet is connected to the high pressure water source, the high pressure water source flows through the water inlet to the water outlet, then flows through the water outlet to the first water jet and the second water jet, and is sprayed out from the first water jet and the second water jet to clean the floor or the vehicle bottom. Moreover, because one end of the connector is rotatably connected to the water outlet, and the other end of the connector is connected to the water spray rod, when the water inlet is connected to the high pressure water source, the high pressure water source flows through the water inlet to the water outlet, and then flows through the water outlet to the first water jet on one side of the water spray rod and the second water jet on the other side of the water spray rod. The pressure of the high pressure water source will drive the water spray rod to rotate at high speed along an axis direction of the connector and the water outlet, such that the first water jet on one side of the water spray rod and the second water jet on the other side of the water spray rod rotate at high speed with the water spay rod along the axis direction of the connector and the water outlet. Subsequently, the high pressure water source sprayed from the first water jet and the second water jet forms a high pressure rotational flow to spray wash the vehicle bottom. In this way, the spraying range, spraying intensity and spraying efficiency can be effectively improved.

In this embodiment, a splash shield 7 is provided on the lower side of the housing 1. The splash shield 7 is formed by stacking a number of layers of flexible screw rods 71. With the above structure, when the first water jet on one side of the water spray rod and the second water jet on the other side of the water spray rod rotate at high speed with the water spray rod along the axis direction of the connector and the water outlet, and the high pressure water source sprayed from the first water jet and the second water jet forms a high pressure rotational flow to spray wash the floor and the vehicle bottom, the splash shield can prevent the high pressure rotational flow from splashing out to wet the user. Further, the number of the screw rods is at least two layers. The at least two layers of screw rods 71 are stacked to form the splash shield. The first layer of screw rods intercept most of the high pressure rotational flow in the housing. The second layer of screw rods further intercept the water intercepted by the first layer of screw rods to achieve the function of splash shielding. The splash shielding effect is higher, which can effectively prevent the user from being wet by the high pressure rotational flow.

In this embodiment, the wheel assembly 4 includes a wheel 41 and a wheel bracket 42. The wheel 41 is connected to the wheel bracket 42. The wheel bracket 42 is rotatably connected to the connecting bracket 61 by a rotating shaft 421. With the above structure, as the wheel bracket is rotatably connected to the connecting bracket through the rotating shaft, the wheel bracket is rotatable along an axis direction of the rotating shaft. Therefore, the wheel can turn along the axis direction of the rotating shaft with the wheel bracket and can travel in multiple directions to move the multifunctional cleaning machine conveniently to clean the floor and the vehicle bottom.

In this embodiment, the connecting shaft 61 is further provided with a locking thread 613. The multifunctional cleaner further includes a locking nut 614. When the locking bracket 51 and the connecting bracket 62 sleeve the connecting shaft 61, the locking nut 614 is connected to the locking thread 613 to press and lock the locking bracket 51 and the connecting bracket 62 to the connecting shaft 61. A decorative cap 8 is further included. When the locking nut 614 is connected to the locking thread 613 to press and lock the locking bracket 51 and the connecting bracket 62 to the connecting shaft 61, the decorative cap covers the connecting shaft and the locking nut. With the above structure, the connection between the locking bracket, the connecting bracket, and the connecting shaft is effectively realized. Moreover, with the decorative cap covering the connecting shaft and the locking nut, the appearance is more flat and attractive.

In this embodiment, the housing 1 is provided with a third connecting port 12. The connecting assembly 6 also includes a first connecting member 63. The locking bracket 51 is also provided with a fourth connecting port 512. The first connecting member 63 penetrates into the fourth connecting port 512 and the third connecting port 12 in turn to lock the locking bracket 51 to the housing 1.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A multifunctional cleaning machine, comprising:

a housing;

a pipe, connected to the housing, the pipe comprising a water inlet and a water outlet, the water inlet being located on an upper side of the housing, the water outlet being located on a lower side of the housing, and the water inlet being configured for connecting to a water source;

a nozzle, connected to the water outlet;

a connecting assembly;

a plurality of wheel assemblies, rotatably connected to the housing by the connecting assembly;

a locking means, connected to the housing and configured for locking a wheel assembly;

when the locking means is released from locking the wheel assembly, the wheel assembly being flippable from the lower side of the housing to the upper side of the housing, or the wheel assembly being flippable from the upper side of the housing to the lower side of the housing; and when the locking means locks the wheel assembly, the locking means locking and fixing the wheel assembly to the lower side of the housing or the upper side of the housing;

wherein the connecting assembly comprises a connecting shaft, a connecting bracket, and a locking bracket, the locking bracket being connected to the housing; the locking bracket is provided with a first connecting port, the connecting shaft is connected to a third connecting port, and the connecting shaft is rotatable within the third connecting port; the wheel assembly is connected to the connecting bracket, such that the wheel assembly and the connecting bracket are integrated into a whole; and the connecting bracket is provided with a second connecting port, and the connecting bracket sleeves the connecting shaft through the second connecting port, such that the connecting bracket and the wheel assembly are rotatable with the connecting shaft.

2. The multifunctional cleaning machine according to claim 1, wherein the locking means is a locking rod, the locking rod being configured for locking the connecting shaft; when the locking rod is released from locking the connecting shaft, the connecting shaft is rotatable within the first connecting port, and the connecting bracket and the wheel assembly are rotatable with the connecting shaft, such that the wheel assembly is flippable from the lower side of the housing to the upper side of the housing, or the wheel assembly is flippable from the upper side of the housing to the lower side of the housing; and when the locking rod locks the connecting shaft, the connecting shaft is not rotatable within the first connecting port, the connecting bracket and the wheel assembly are not rotatable with the connecting shaft, such that the wheel assembly is locked and fixed to the lower side of the housing or the upper side of the housing.

3. The multifunctional cleaning machine according to claim 2, wherein the locking bracket is further provided with a locking channel, the locking channel passes through an outer side of the locking bracket to the second connecting port, and the locking rod is slidable within the locking channel; the connecting shaft is provided with a first locking hole and a second locking hole, when the locking rod slides within the locking channel into the first locking hole, the locking rod locks the connecting shaft, and the connecting shaft is not rotatable within the first connecting port, such that the locking rod locks and fixes the wheel assembly to the lower side of the housing; when the locking rod slides within the locking channel into the second locking hole, the locking rod locks the connecting shaft, and the connecting shaft is not rotatable within the first connecting port, such that the locking rod locks and fixes the wheel assembly to the upper side of the housing; and when the locking rod slides out of the locking channel to disengage from the first locking hole or the second locking hole, the connecting shaft is rotatable within the first connecting port, and the connecting bracket and the wheel assembly are rotatable with the connecting shaft, such that the wheel assembly is flippable from the lower side of the housing to the upper side of the housing, or the wheel assembly is flippable from the upper side of the housing to the lower side of the housing.

4. The multifunctional cleaning machine according to claim 3, wherein the locking rod is sleeved with a resilient reset means, when the locking rod slides out of the locking channel to disengage from the first locking hole or the second locking hole, the resilient reset means is compressed; and when the locking rod slides within the locking channel into the first locking hole or the second locking hole, a resilient reset force provided by the resilient reset means when compressed can push the locking rod to be locked in the first locking hole or the second locking hole.

5. The multifunctional cleaning machine according to claim 1, wherein a splash shield is provided on the lower side of the housing.

6. The multifunctional cleaning machine according to claim 1, wherein the wheel assembly comprises a wheel and a wheel bracket, the wheel is connected to the wheel bracket, and the wheel bracket is rotatably connected to the connecting bracket through a rotating shaft.

7. The multifunctional cleaning machine according to claim 2, wherein the connecting shaft is further provided with a locking thread, the multifunctional cleaner further comprises a locking nut, and when the locking bracket and the connecting bracket sleeve the connecting shaft, the locking nut is connected to the locking thread to press and lock the locking bracket and the connecting bracket to the connecting shaft.

8. A multifunctional cleaning machine, comprising:

a housing;

a pipe, connected to the housing, the pipe comprising a water inlet and a water outlet, the water inlet being located on an upper side of the housing, the water outlet being located on a lower side of the housing, and the water inlet being configured for connecting to a water source;

a nozzle, connected to the water outlet;

a connecting assembly;

a plurality of wheel assemblies, rotatably connected to the housing by the connecting assembly;

a locking means, connected to the housing and configured for locking a wheel assembly;

when the locking means is released from locking the wheel assembly, the wheel assembly being flippable from the lower side of the housing to the upper side of the housing, or the wheel assembly being flippable from the upper side of the housing to the lower side of the housing; and when the locking means locks the wheel assembly, the locking means locking and fixing the wheel assembly to the lower side of the housing or the upper side of the housing;

wherein the nozzle is T-shaped to form a connector at an upper side and a water spray rod at a lower side, one end of the connector is rotatably connected to the water outlet, and the other end of the connector is connected to the water spray rod; and a first water jet is provided on one side of the water spray rod, and a second water jet is provided on the other side of the water spray rod.

9. A multifunctional cleaning machine, comprising:

a housing;

a pipe, connected to the housing, the pipe comprising a water inlet and a water outlet, the water inlet being located on an upper side of the housing, the water outlet being located on a lower side of the housing, and the water inlet being configured for connecting to a water source;

a nozzle, connected to the water outlet;

a connecting assembly;

a plurality of wheel assemblies, rotatably connected to the housing by the connecting assembly;

a locking means, connected to the housing and configured for locking a wheel assembly;

when the locking means is released from locking the wheel assembly, the wheel assembly being flippable from the lower side of the housing to the upper side of the housing, or the wheel assembly being flippable from the upper side of the housing to the lower side of the housing; and when the locking means locks the wheel assembly, the locking means locking and fixing the wheel assembly to the lower side of the housing or the upper side of the housing;

wherein the splash shield is formed by stacking a number of layers of screw rods.

* * * * *